US010614924B2

(12) United States Patent
Singh

(10) Patent No.: US 10,614,924 B2
(45) **Date of Patent: *Apr. 7, 2020**

(54) MANIFOLD SYSTEM FOR THE VENTILATED STORAGE OF HIGH LEVEL WASTE AND A METHOD OF USING THE SAME TO STORE HIGH LEVEL WASTE IN A BELOW-GRADE ENVIRONMENT

(71) Applicant: Holtec International, Camden, NJ (US)

(72) Inventor: Krishna P. Singh, Hobe Sound, FL (US)

(73) Assignee: HOLTEC INTERNATIONAL, Camden, NJ (US)

( * ) Notice: Subject to any disclaimer, the term of this patent is extended or adjusted under 35 U.S.C. 154(b) by 326 days.

This patent is subject to a terminal disclaimer.

(21) Appl. No.: 15/702,241

(22) Filed: Sep. 12, 2017

(65) Prior Publication Data

US 2018/0053576 A1 Feb. 22, 2018

Related U.S. Application Data

(60) Continuation of application No. 14/271,101, filed on May 6, 2014, now Pat. No. 9,761,339, which is a (Continued)

(51) Int. Cl.

| | |
|---|---|
| ***G21F 5/10*** | (2006.01) |
| ***G21F 9/34*** | (2006.01) |
| ***G21F 7/015*** | (2006.01) |

(52) U.S. Cl.

CPC ..... *G21F 5/10* (2013.01); *G21F 7/015* (2013.01); *G21F 9/34* (2013.01)

(58) Field of Classification Search

CPC ..... G21F 7/015; G21F 9/34

See application file for complete search history.

(56) References Cited

U.S. PATENT DOCUMENTS

| | | | |
|---|---|---|---|
| 3,111,078 | A | 11/1963 | Breckenridge |
| 3,111,586 | A | 11/1963 | Rogers |

(Continued)

FOREIGN PATENT DOCUMENTS

| | | |
|---|---|---|
| DE | 340466 | 9/1921 |
| DE | 2821780 | 11/1979 |

(Continued)

*Primary Examiner* — Sharon M Davis

(74) *Attorney, Agent, or Firm* — The Belles Group, P.C.

(57) ABSTRACT

A system and method for storing multiple canisters containing high level waste below grade that afford adequate ventilation of the spent fuel storage cavity. In one aspect, the invention is a ventilated system for storing high level waste emitting heat, the system comprising: an air-intake shell forming an air-intake cavity; a plurality of storage shells, each storage shell forming a storage cavity; a lid positioned atop each of the storage shells; an outlet vent forming a passageway between an ambient environment and a top portion of each of the storage cavities; and a network of pipes forming her sealed passageways between a bottom portion of the air-intake cavity and at least two different openings at a bottom portion of each of the storage cavities such that blockage of a first one of the openings does not prohibit air from flowing from the air-intake cavity into the storage cavity via a second one of the openings.

1 Claim, 9 Drawing Sheets

Related U.S. Application Data division of application No. 12/709,094, filed on Feb. 19, 2010, now Pat. No. 8,718,220, which is a continuation-in-part of application No. 11/352,601, filed on Feb. 13, 2006, now Pat. No. 7,676,016.

(60) Provisional application No. 60/652,363, filed on Feb. 11, 2005.

(56) References Cited

U.S. PATENT DOCUMENTS

| | | | |
|---|---|---|---|
| 3,629,062 | A | 12/1971 | Muenchow |
| 3,739,451 | A | 6/1973 | Jacobson |
| 3,745,707 | A | 7/1973 | Herr |
| 3,765,079 | A | 10/1973 | Pfefferie et al. |
| 3,765,549 | A | 10/1973 | Jones |
| 3,800,973 | A | 4/1974 | Weaver |
| 3,836,267 | A | 9/1974 | Schatz |
| 3,910,006 | A | 10/1975 | James |
| 3,911,684 | A | 10/1975 | Busey |
| 3,917,953 | A | 11/1975 | Wodrich |
| 3,935,062 | A | 1/1976 | Keller et al. |
| 3,945,509 | A | 3/1976 | Weems |
| 3,962,587 | A | 6/1976 | Dufrane et al. |
| 3,984,942 | A | 10/1976 | Schroth |
| 4,055,508 | A | 10/1977 | Yoli et al. |
| 4,078,968 | A | 3/1978 | Golden et al. |
| 4,158,599 | A | 6/1979 | Andrews et al. |
| 4,278,892 | A | 7/1981 | Baatz et al. |
| 4,288,698 | A | 9/1981 | Baatz et al. |
| 4,355,000 | A | 10/1982 | Lumelleau |
| 4,356,146 | A | 10/1982 | Knappe et al. |
| 4,366,095 | A | 12/1982 | Takats et al. |
| 4,386,460 | A | 6/1983 | Klockow |
| 4,394,022 | A | 7/1983 | Gilmore |
| 4,450,134 | A | 5/1984 | Soot et al. |
| 4,498,011 | A | 2/1985 | Dyck et al. |
| 4,526,324 | A | 7/1985 | Spilker et al. |
| 4,526,344 | A | 7/1985 | Oswald et al. |
| 4,527,066 | A | 7/1985 | Dyck et al. |
| 4,527,067 | A | 7/1985 | Dyck et al. |
| 4,532,428 | A | 7/1985 | Dyck et al. |
| 4,585,611 | A | 4/1986 | Perl |
| 4,634,875 | A | 1/1987 | Kugeler et al. |
| 4,635,477 | A | 1/1987 | Simon |
| 4,649,018 | A | 3/1987 | Waltersdorf et al. |
| 4,663,533 | A | 5/1987 | Kok et al. |
| 4,671,326 | A | 6/1987 | Wilhelm et al. |
| 4,690,795 | A | 9/1987 | Hardin, Jr. et al. |
| 4,764,333 | A | 8/1988 | Minshall et al. |
| 4,780,269 | A | 10/1988 | Fischer et al. |
| 4,800,062 | A | 1/1989 | Craig et al. |
| 4,834,916 | A | 5/1989 | Chaudon et al. |
| 4,847,009 | A | 7/1989 | Madle et al. |
| 4,851,183 | A | 7/1989 | Hampel |
| 4,890,269 | A | 12/1989 | Buckner et al. |
| 4,971,752 | A | 11/1990 | Parker |
| 5,102,615 | A | 4/1992 | Grande et al. |
| 5,182,076 | A | 1/1993 | De Seroux et al. |
| 5,267,280 | A | 11/1993 | Duquesne |
| 5,297,917 | A | 3/1994 | Freneix |
| 5,307,388 | A | 4/1994 | Inkester et al. |
| 5,319,686 | A | 6/1994 | Pizzano et al. |
| 5,387,741 | A | 2/1995 | Shuttle |
| 5,469,936 | A | 11/1995 | Lauga et al. |
| 5,513,231 | A | 4/1996 | Jones et al. |
| 5,513,232 | A | 4/1996 | Jones et al. |
| 5,546,436 | A | 8/1996 | Jones et al. |
| 5,564,498 | A | 10/1996 | Bochard |
| 5,633,904 | A | 5/1997 | Gilligan, III et al. |
| 5,646,971 | A | 7/1997 | Howe |
| 5,661,768 | A | 8/1997 | Gilligan, III et al. |
| 5,753,925 | A | 5/1998 | Yamanaka et al. |
| 5,771,265 | A | 6/1998 | Montazer |
| 5,862,195 | A | 1/1999 | Peterson, II |
| 5,926,602 | A | 7/1999 | Okura |
| 6,064,710 | A | 5/2000 | Singh |
| 6,064,711 | A | 5/2000 | Copson |
| 6,252,923 | B1 | 6/2001 | Iacovino et al. |
| 6,519,307 | B1 | 2/2003 | Singh et al. |
| 6,719,000 | B1 | 4/2004 | Forsythe et al. |
| 7,068,748 | B2 | 6/2006 | Singh |

FOREIGN PATENT DOCUMENTS

| | | |
|---|---|---|
| DE | 3107158 | 1/1983 |
| DE | 3144113 | 5/1983 |
| DE | 3151475 | 5/1983 |
| DE | 3515871 | 11/1986 |
| DE | 19529357 | 2/1997 |
| EP | 106100 | 4/1984 |
| EP | 0253730 | 1/1988 |
| FR | 2434463 | 3/1980 |
| GB | 2295484 | 5/1996 |
| GB | 2327722 | 2/1999 |
| GB | 2337722 | 12/1999 |
| JP | 621851999 | 8/1987 |
| JP | 11190799 | 7/1999 |
| KR | 20000000022 | 1/2000 |
| RU | 2168022 | 5/2001 |

MANIFOLD SYSTEM FOR THE VENTILATED STORAGE OF HIGH LEVEL WASTE AND A METHOD OF USING THE SAME TO STORE HIGH LEVEL WASTE IN A BELOW-GRADE ENVIRONMENT

CROSS-REFERENCE TO RELATED APPLICATIONS

The present application is a continuation of U.S. patent application Ser. No. 14/271,101 filed May 6, 2014, which is a divisional of U.S. patent application Ser. No. 12/709,094 filed Feb. 19, 2010, which is a continuation-in-part of U.S. Non-provisional patent application Ser. No. 11/352,601, filed Feb. 13, 2006, which in turn claims the benefit of U.S. Provisional Patent Application 60/652,363, filed Feb. 11, 2005, the entireties of which are hereby incorporated by reference in its entirety.

BACKGROUND

The present invention relates generally to the field of storing high level waste, and specifically to systems and methods for storing spent nuclear fuel in ventilated vertical modules that utilize passive convective cooling.

In the operation of nuclear reactors, it is customary to remove fuel assemblies after their energy has been depleted down to a predetermined level. Upon removal, this spent nuclear fuel is still highly radioactive and produces considerable heat, requiring that great care be taken in its packaging, transporting, and storing. In order to protect the environment from radiation exposure, spent nuclear fuel is first placed in a transportable canister. An example of a typical canister used to transport, and eventually store, spent nuclear fuel is disclosed in U.S. Pat. No. 5,898,747 to Krishna Singh, issued Apr. 27, 1999. Such canisters are commonly referred to in the art as multi-purpose canisters ("MPCs") and are hermetically sealable to effectuate the dry storage of spent nuclear fuel.

Once the canister is loaded with the spent nuclear fuel, the loaded canister is transported and stored in large cylindrical containers called casks. A transfer cask is used to transport spent nuclear fuel from location to location while a storage cask is used to store spent nuclear fuel for a determined period of time.

In a typical nuclear power plant, an open empty canister is first placed in an open transfer cask. The transfer cask and empty canister are then submerged in a pool of water. Spent nuclear fuel is loaded into the canister while the canister and transfer cask remain submerged in the pool of water. Once fully loaded with spent nuclear fuel, a lid is typically placed atop the canister while in the pool. The transfer cask and canister are then removed from the pool of water, the lid of the canister is welded thereon and a lid is installed on the transfer cask. The canister is then properly dewatered and back filled with inert gas. The canister is then hermetically sealed. The transfer cask (which is holding the loaded and hermetically sealed canister) is transported to a location where a storage cask is located. The canister is then transferred from the transfer cask to the storage cask for long term storage. During transfer from the transfer cask to the storage cask, it is imperative that the loaded canister is not exposed to the environment.

One type of storage cask is a ventilated vertical overpack ("VVO"). A VVO is a massive structure made principally from steel and concrete and is used to store a canister loaded with spent nuclear fuel. Existing VVOs stand above ground and are typically cylindrical in Shape and extremely heavy, weighing over 150 tons and often having a height greater than 16 feet. VVOs typically have a flat bottom, a cylindrical body having a cavity to receive a canister of spent nuclear fuel, and a removable top lid.

In using a VVO to store spent nuclear fuel, a canister loaded with spent nuclear fuel is placed in the cavity of the cylindrical body of the VVO. Because the spent nuclear fuel is still producing a considerable amount of heat when it is placed in the VVO for storage, it is necessary that this heat energy have the ability to escape from the VVO cavity. This heat energy is removed from the outside surface of the canister by passively ventilating the VVO cavity using natural convective forces. In passively ventilating the VVO cavity, cool air enters the VVO chamber through bottom ventilation ducts, flows upward past the loaded canister, and exits the VVO at an elevated temperature through top ventilation ducts. The bottom and top ventilation ducts of existing VVOs are located circumferentially near the bottom and top of the VVO's cylindrical body respectively, as illustrated in FIG. 1.

While it is necessary that the VVO cavity be vented so that heat can escape from the canister, it is also imperative that the VVO provide adequate radiation shielding and that the spent nuclear fuel not be directly exposed to the external environment. The inlet duct located near the bottom, of the overpack is a particularly vulnerable source of radiation exposure to security and surveillance personnel who, in order to monitor the loaded overpacks, must place themselves in close vicinity of the ducts for short durations.

Additionally, when a canister loaded with spent nuclear fuel is transferred from a transfer cask to a storage VVO, the transfer cask is stacked atop the storage VVO so that the canister can be lowered into the storage VVO's cavity. Most casks are very large structures and can weigh up to 250,000 lbs. and have a height of 16 ft. or more. Stacking a transfer cask atop a storage VVO/cask requires a lot of space, a large overhead crane, and possibly a restraint system for stabilization. Often, such space is not available inside a nuclear power plant. Finally, above ground storage VVOs stand at least 16 feet above ground, thus, presenting a sizable target of attack to a terrorist.

FIG. 1 illustrates a traditional prior art VVO 1. The prior art VVO 1 comprises a flat bottom 7, a cylindrical body 2, and a lid 4. The lid 4 is secured to a cylindrical body 2 by a plurality of bolts 8. The bolts 8 serve to restrain separation of the lid 4 from the body 2 if the prior art VVO 1 were to tip over. The cylindrical body 2 has a plurality of top ventilation ducts 5 and a plurality of bottom ventilation ducts 6. The top ventilation ducts 5 are located at or near the top of the cylindrical body 2 while the bottom ventilation ducts 6 are located at or near the bottom of the cylindrical body 2. Both the bottom ventilation ducts 6 and the top ventilation ducts 5 are located around the circumference of the cylindrical body 2. The entirety of the prior art VVO 2 is positioned above grade and, therefore, suffers from a number of the drawbacks discussed above and remedied by the present invention.

SUMMARY

It is therefore an object of the present invention to provide a system and method for storing high level waste, such as spent nuclear fuel, that reduces the height of the stack assembly during canister transfer procedure.

Another object of the present invention to provide a system and method for storing high level waste, such as spent nuclear fuel, that requires less vertical space.

Yet another object of the present invention is to provide a system and method for storing high level waste, such as spent nuclear fuel, that utilizes the radiation shielding properties of the subgrade during storage while providing adequate passive ventilation of the high level waste.

A further object of the present invention is to provide a system and method for storing high level waste, such as spent nuclear fuel, that provides the same or greater level of operational safeguards that are available inside a fully certified nuclear power plant structure.

A still further object of the present invention is to provide a system and method for storing high level waste, such as spent nuclear fuel, that decreases the dangers presented by earthquakes and other catastrophic events and virtually eliminates the potential damage from a World Trade Center or Pentagon type of attack on the stored canister.

It is also an object of the present invention to provide a system and method for storing high level waste, such as spent nuclear fuel, that allows an ergonomic transfer of the high level waste from a transfer cask to a storage VVO.

Another object of the present invention is to provide a system and method for storing high level waste, such as spent nuclear fuel, below grade.

Yet another object of the present invention is to provide a system and method of storing high level waste, such as spent nuclear fuel, that reduces the amount of radiation emitted to the environment.

Still another Object of the present invention is to provide a system and method of storing a plurality of canisters containing high level waste in separate below grade cavities while facilitating adequate passive ventilated cooling of each canister.

These and other objects are met by the present invention which in one aspect is a system for storing high level waste emitting a heat load, comprising: an air-intake shell forming a substantially vertical air-intake cavity; a plurality of storage shells, each storage shell terming a substantially vertical storage cavity; a hermetically sealed canister for holding high level waste positioned in each of the storage cavities so that a gap exists between the storage shell and the canister, the horizontal cross-section of each storage cavity accommodating no more than one canister; a removable lid positioned atop each of the storage shells so as to form a lid-to-shell interface, the lid containing an outlet vent forming a passageway between an ambient environment and the storage cavity; and a network of pipes forming a passageway between a bottom portion of the intake cavity and a bottom portion of each of the storage cavities.

Preferably, the system of the present invention is used to store spent nuclear fuel in a below grade environment. In such an embodiment, the storage shells are positioned so that at least a major portion of their height is located below grade (i.e., below the surface level of the ground). The network of pipes are also located below grade while the lids positioned atop the storage shells are located above grade. A radiation absorbing material preferably surrounds the storage shells and covers the network of pipes. The radiation absorbing material can be concrete, an engineered fill, soil, and/or a combination thereof.

It is further preferable that the storage shells, the air-intake shell, the network of pipes, and all connections therebetween be hermetically constructed so as to prohibit the ingress of below grade liquids. The air-intake shell, the storage shells and the network of pipes are preferably constructed of a metal or alloy. All connections can be achieved by welding or other suitable procedures that result in an integral hermetic structure.

In this below grade embodiment of the system, the air-intake cavity forms an air passageway between the above grade air and the network of pipes. Similarly, the vents in the lids positioned atop the storage shells form passageways between the storage cavitiesand the above grade air. As a result of this design, when the hermetically sealed canisters (which are loaded with the hot high level waste) are loaded in the storage cavities, cool ambient air will enter the air-intake cavity, travel through the network of pipes, and enter the bottom portion of the storage cavities. Heat from the high level waste within the canisters will warm the cool air causing it to rise through the gap that exists between the storage shell and the canister. Upon continuing to rise, the heated air will then exit the storage cavities via the vents in the lids. The chimney effect of the heated air escaping the storage cavities siphons additional cool air into the air-intake cavity, through the network of pipes, and into the storage cavities. Thus, the below grade storage of multiple spent nuclear fuel canisters can be achieved while affording adequate ventilation for cooling.

As in typical overpack systems, the canisters are preferably non-fixedly positioned within the storage cavities in a substantially vertical orientation. In other words, the canisters are positioned within the storage cavities free of anchors and are free-standing. As a result, the canisters can be easily inserted, removed and transferred from the storage cavities, as necessary.

A lid can also be positioned atop the air-intake shell so as to form a lid-to-shell interface with the air-intake shell. This lid preferably contains an inlet vent that forms a passageway between the ambient environment and the air-intake cavity. As a result, cool air can be siphoned into the air-intake cavity while prohibiting the entrance of debris and/or rain water.

The network of pipes preferably comprises one or more headers that couple the storage shells to the air-intake shell. The headers act as a manifold and assist in evenly distributing the incoming cool air to the storage cavities. A layer of insulating material can also be provided to circumferentially surround the storage shells. The insulation facilitates in prohibiting the incoming cool air from becoming: heated prior to entering the storage cavities. In other words, the insulation prohibits the heat emanated by the canisters from conducting into the radiation absorbing material surrounding the storage shells, thereby keeping the air-intake cavity and the network of pipes cool.

Preferably, the system further comprises means for supporting the canisters in the storage cavities so that a first plenum exists between a bottom of the canister and a floor of the storage cavity. It is further preferable that a second plenum exists between a top of the canister and a bottom surface of the lid that encloses the storage cavity. In this embodiment, the network of pipes form passageways between the air-intake cavity and the first plenums while the outlet vents within the lids form passageways between the ambient environment and the second plenums. In one embodiment, the support means can comprise a plurality of circumferentially spaced support blocks.

It is further preferable that the gaps that exist between the storage shells and the canisters be a small annular gap. In one embodiment, the storage shells can surround the air-intake shell so as to form an array of shells, arranged in side-by-side relation. The dimensions of the array can vary as desired.

In another aspect, the invention can be a ventilated, system for storing high level waste having a heat load, the system comprising: an array of substantially vertically oriented shells arranged in a side-by-side relation, each shell forming a cavity a hermetically sealed canister for holding high level waste positioned in one or more of the cavities, the cavities having a horizontal cross-section that accommodates no more than one of the canisters; a removable lid positioned atop each of the shells so as to form a lid-to-shell interface, each lid containing a vent forming a passageway between an ambient environment and the storage cavity; a network of pipes forming air passageways between bottoms of all of the cavities; and wherein at least one of the cavities is empty so as to allow cool air to enter the network of pipes.

In yet another aspect, the invention is a method of storing and passively ventilating high level waste comprising: providing a system comprising an array of substantially vertically oriented shells arranged in a side-by-side relation, each shell forming a cavity, and a network of pipes forming air passageways between bottom portions of all of the cavities; positioning the system in a below grade hole so that a major portion of the height of the shells is below grade; filling the below grade hole with a radiation absorbing material so as to surround the shells and cover the network of pipes, the cavities being accessible from above grade; lowering a hermetically sealed canister containing high level waste into the cavity of one or more of the shells so that a gap exists between the canister and the shell, the cavity having a horizontal cross-section that accommodates no more than one of the canisters; positioning a removable lid atop the shell containing the canister so as to form a lid-to-shell interface, the lid containing a vent forming a passageway between an above grade atmosphere and the cavity containing the canister; maintaining at least one of the cavities empty; and cool an entering the empty cavity the cool air being draw into the network of pipes and into the cavity containing the canister, the cool air being warmed by heat from the canister, the warm air rising in the gap and exiting the cavity through the vent of the lid.

In a further aspect, the invention can be a ventilated system for storing high level waste emitting heat, the system comprising: an air-intake shell forming an air-intake cavity; a plurality of storage shells, each storage shell forming a storage cavity; a lid positioned atop each of the storage shells; an outlet vent forming a passageway between an ambient environment and a top portion of each of the storage cavities; and a network of pipes forming hermetically sealed passageways between a bottom portion of the air-intake cavity and at least two different openings at a bottom portion of each of the storage cavities such that blockage of a first one of the openings does not prohibit air from flowing from the air-intake cavity into the storage cavity via a second one of the openings.

In another aspect, the invention can be a ventilated system for storing high level waste emitting heat, the system comprising: an air-intake shell forming an air-intake cavity; a plurality of storage shells, each storage shell forming a storage cavity; a lid positioned atop each of the storage shells; an outlet vent forming a passageway between an ambient environment and a top portion of each of the storage cavities; and a network of pipes forming hermetically sealed passageways between a bottom portion of the air-intake cavity and a bottom portion of each of the storage cavities, wherein the network of pipes is configured so that a line of sight does not exist between any of the storage cavities through the passageways.

DETAILED DESCRIPTION

Figure 2:
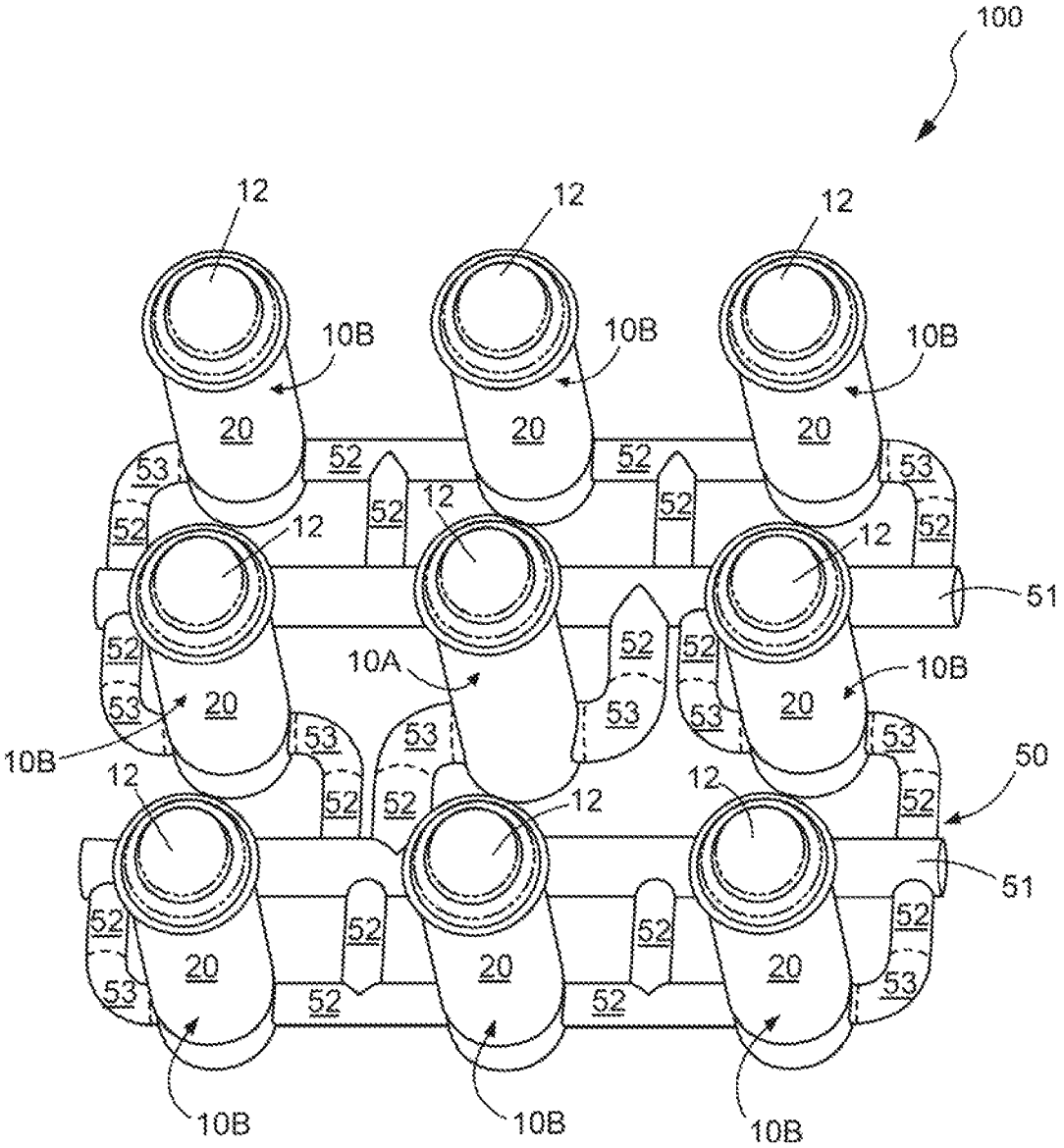
FIG. 2 is a top perspective view of a manifold storage system according to an embodiment of the present invention.

Referring first to FIG. 2, a manifold storage system 100 is illustrated according to an embodiment of the present invention. As illustrated in FIG. 2, the manifold storage system 100 is removed from the ground. However, as will be discussed in greater detail below, the manifold storage system 100 is specifically designed to achieve the dry storage of multiple hermetically sealed canisters containing spent nuclear fuel in a below grade environment.

Figure 1:
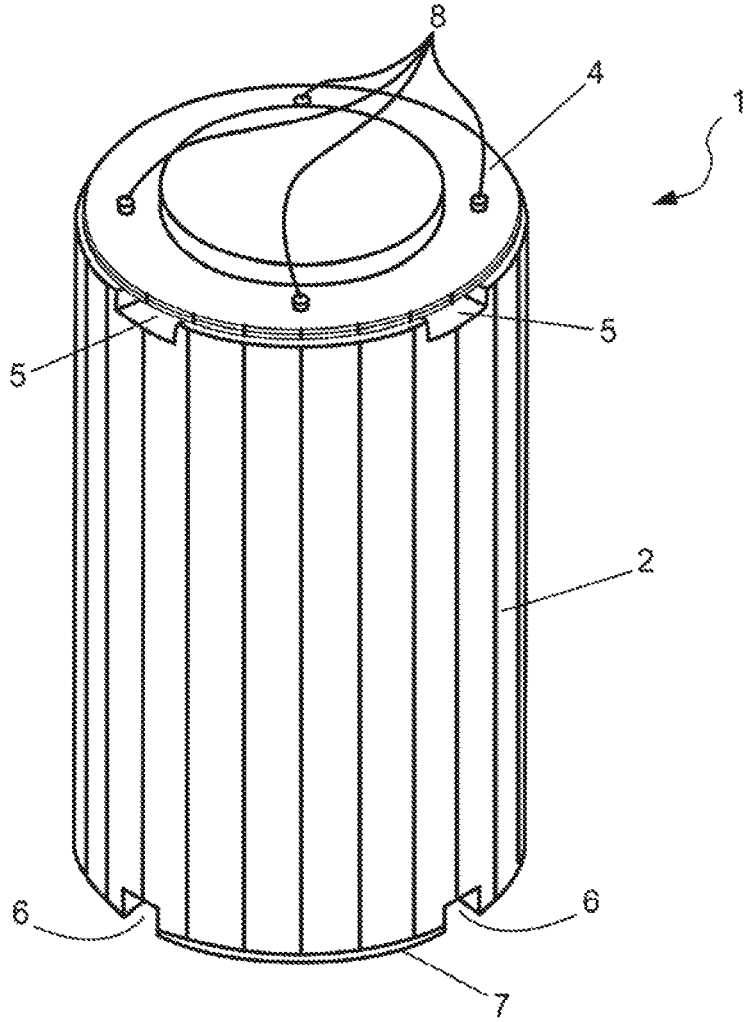
FIG. 1 is a top perspective view of a prior art VVO.

The manifold storage system 100 is a vertical, ventilated dry spent fuel storage system that is fully compatible with 100 ton and 125 ton transfer casks for spent fuel canister transfer operations. The manifold storage system 100 can be modified/designed to be compatible with any size or style transfer cask. The manifold storage system 100 is designed to accept multiple spent fuel canisters for storage at an Independent Spent Fuel Storage Installation ("ISFSI") in lieu of above ground overpacks (such as prior art VVO 2 in FIG. 1).

All canister types engineered for the dry storage of spent fuel in above-grade overpack models can be stored in the manifold storage system 100. Suitable canisters include multi-purpose canisters ("MPCs") and thermally conductive casks that are hermetically sealed for the dry storage of high level wastes, such as spent nuclear fuel. Typically, such canisters comprise a honeycomb grid-work/basket, or other structure, built directly therein to accommodate a plurality of spent fuel rods in spaced relation. An example of an MPC that is particularly suitable for use in the present invention is disclosed in U.S. Pat. No. 5,898,747 to Krishna Singh, issued Apr. 27, 1999 the entirety of which is hereby incorporated by reference. In some embodiments, the invention may include the canister or MPC positioned within the manifold storage system 100.

The manifold storage system 100 is a storage system that facilitates the passive cooling of storage canisters through natural convention/ventilation. The manifold storage system 100 is free of forced cooling equipment, such as blowers and closed-loop cooling systems. Instead, the manifold storage system 100 utilizes the natural phenomena of rising warmed air, i.e., the chimney effect, to effectuate the necessary circulation of air about the canisters. In essence, the manifold storage system 100 comprises a plurality of modified ventilated vertical modules that can achieve the necessary ventilation/cooling of multiple canisters containing spent nuclear in a below grade environment.

The manifold storage system 100 comprises a vertically oriented air-intake shell 10A and a plurality of vertically oriented storage shells 10B. The storage shells 10B surround the air-intake shell 10A. In the exemplified embodiment, the air-intake shell 10A is structurally identical to the storage shells 10B. However, as will be discussed below, the air-intake shell 10A is intended to remain empty (i.e., free of a heat load and unobstructed) so that it can act as an inlet passageway for cool air into the manifold storage system 100. The storage shells 10B are adapted to receive hermetically sealed canisters containing spent nuclear fuel and to act as storage/cooling chamber for the canisters. However, in some embodiment of the invention, the air-intake shell 10A can be designed to be structurally different than the storage shells 10B so long as the internal cavity of the air-intake shell 10A allows the inlet of cool air for ventilating the storage shells 10B. Stated simply, the cavity of the air-intake shell 10A acts as a downcomer passageway for the inlet of cooling air into the piping network 50. For example, the air-intake shell 10A can have a cross-sectional shape, cross-sectional size, material of construction and/or height that can be different than that of the storage shells 10B. While the air-intake shell 10A is intended to remain empty during normal operation and use, if the heat load of the canisters being stored in the storage shells 10B is sufficiently low such that circulating air flow is not needed, the air-intake shell 10A can be used to store a canister of spent fuel.

Both the air-intake shell 10A and the storage shells 10B are cylindrical in shape. However, in other embodiments the shells 10A, 10B can take on other shapes, such as rectangular, etc. The shells 10A, 10B have an open top end and a dosed bottom end The shells 10A, 10B are arranged in a side-by-side orientation forming a 3×3 array. The air-intake shell 10A is located in the center of the 3×3 array. It should be noted that while it is preferable that the air-intake shell 10A be centrally located, the invention is not so limited. The location of the air-intake shell 10A in the array can be varied as desired by simply leaving one or more of the storage shells 10B empty. Moreover, while the illustrated embodiment of the manifold storage system 100 comprises a 3×3 array of the shells 10A, 10B, and other array sizes and/or arrangements can be implemented in alternative embodiments of the invention.

The shells 10A, 10B are preferably spaced apart in a side-by-side relation. The horizontal distance between the vertical center axis of the shells 10A, 10B is in the range of about 10 to 20 feet, and more preferably about 15 feet. However, the exact distance between shells will be determined on case by case basis and is not limiting of the present invention.

The shells 10A, 10B are preferably constructed of a thick metal, such as steel, including low carbon steel. However, other materials can be used, including without limitation metals, alloys and plastics. Other examples include stainless steel, aluminum, aluminum-alloys, lead, and the like. The thickness of the shells 10A, 10B is preferably in the range of 0.5 to 4 inches, and most preferably about 1 inch. However, the exact thickness of the shells 10A, 10B will be determined on a case-by-case basis, considering such factors as the material of construction, the heat load of the spent fuel being stored, and the radiation level of the spent fuel being stored.

The manifold storage system 100 further comprises a removable lid 12 positioned atop each of the shells 10A, 10B. The lids 12 are positioned atop the shells 10A, 10B, thereby enclosing the open top ends of the cavities formed by the shells 10A, 10B. The lids 12 provide the necessary radiation shielding so as to prevent radiation from escaping upward from the cavities formed by the storage shells 10B when the loaded canisters are positioned therein. The lids are secured to the shells 10A, 10B by bolts or other connection means. The lids 12 are capable of being removed from the shells 10A, 10B without compromising the integrity of and/or otherwise damaging either the lids 12 or the shells 10A, 10B. In other words, each lid 12 forms a non-unitary structure with its corresponding shell 10A, 10B. In certain embodiments, however, the lids 12 may be secured to the shells 10A, 10B via welding or other semi-permanent connection techniques that are implemented once the shells 10A, 10B are loaded with a canister loaded with HLW.

Each of the lids 12 comprises one or more inlet ducts that form a passageway from the ambient air into the cavity formed by the shells 10A, 10B. The structural details of the lids 12 will be discussed in greater detail below with respect to FIGS. 6A and 6B. The interaction of the lids 12 with the shells 10A, 10B will described in greater detail below with respect to FIG. 7. In certain embodiments, however, the lids 12 may be solid structures that do not have passageways therein that allow heated air to escape the shells 10B or that allow cool air to enter the shell 10A. In such an embodiment, the top ends of the shells 10A, 10B may be modified to include ducts that form the necessary fluid passageways into the shells 10A, 10B. For example, cutouts or other holes may be provided on the sidewalls of the shells 10A, 10B themselves to which a tortuous duct is attached that allows air flow to and/or from the interior cavity of the shells 10A, 10B. Suitable structural configurations of storage shells wherein ducts are provided at the top end of the shells are disclosed in U.S. Pat. No. 7,590,213 to Krishna P. Singh, issued Sep. 15, 2009, the entirety of which is hereby incorporated by reference.

Referring still to FIG. 2, the manifold storage system 100 further comprises a network 50 of pipes/ducts that fluidly connect all of the storage shells 10B to the air-intake shell 10A (and to each other). The network 50 comprises two headers 51, a plurality of straight pipes 52, and a plurality of curved expansion joints 53. The headers 51 are used as manifolds to fluidly connect all of the storage shells 10B to the air-intake shell 10A in order to more evenly distribute the flow of incoming cool air to the storage shells 10B as needed. The curved expansion joints 53 provide for thermal expansion: extraction of the network as needed The straight pipes complete the network 50 so that all shells 10A, 10B are hermetically and fluidly connected.

The piping network 50 connects at or near the bottom of the shells 10A, 10B to form a network of fluid passageways between the internal cavities of all of the shells 10A, 10B. Of course, appropriately positioned openings are provided in the sidewalls of the shells 10A, 10B to which the piping network 50 is fluidly coupled. As a result, the piping network 50 provides passageways from the internal cavity of the air-intake shell 10A to all of the internal cavities of the storage shells 10B via the headers 51. As a result, cool air entering the air-intake shell 10A can be distributed to all of the storage shells 10B via the piping network 50. It is preferable that the incoming cool air be supplied to at or near the bottom of the internal cavities of the storage shells 10B (via the openings) to achieve cooling of the canisters positioned therein.

The network of pipes 50 is configured so that the quantity of air drawn by each of the storage shells 10B adjusts to comply with Bernoulli's law. The air-flow through each storage shell 10B (which is effectuated by the canister heat load) is influenced by the air-flow drawn by any other of the storage shells 10B in the network. Additionally, every storage cavity 10B in the network is fed with air by at least two inlet passages such that blockage in any one flow artery will not cause a sharp temperature rise in the affected cells. Thought of another way, the network of pipes 50 is configured so that two different paths exist through the hermetically sealed fluid passageway formed by the network of pipes 50 from the downcomer air-intake cavity of the intake shell 10A to each of the storage cavities of the storage shells 10B. Preferably, neither of the two different paths pass through any of the other storage cavities of the storage shells 10B. However, the invention is not so limited and in some instances.

In certain embodiments, the existence of two different paths through the passageways of the piping network 50 includes situations where two paths exist through the passageways of the piping network that overlap for a portion of the paths, but not the entirety of the two paths. It is further preferred that the final pipe in each of the two different paths not be the same pipe. In this embodiment, the two different paths from the air-intake shell 10A to each storage shell 10B through the passageways of the piping network 50 includes a first path that passes through a first pipe that terminates in a first opening into the a storage shell 10B and a second path that passes through a second pipe that terminates in a second opening into that same storage shell 10B, wherein the first and second pipes are not the same pipe.

The configuration of the piping network 50 makes it resilient to change in environmental conditions, including upset conditions such as a pipe blockage. Moreover, due to the special configuration of the piping, network, if one storage shell 10B in the array was left empty, this empty storage shell 10B would become another air intake downcomer passageway (similar to the air intake shell 10A). In other words, the air in the empty storage shell 10B would flow downwards and begin feeding piping network with cool air. In fact, any storage shell 10B loaded with a low heat emitting canister can also become a downdraft cell. To determine which way the air will flow in any given canister loading situation, one will need to solve a set of non-linear (quadratic in flow) simultaneous equations (Bernoulli's equations for piping networks) with the aid of a computer program. A manual calculation in the manner of Torricelli's law is not possible.

The advantages of the inter-connectivity of the piping network 50 becomes obvious when one considers the consequences of blocking a pipe leading to one storage shell 10B (a compulsory safety question in nuclear plant design work) because that storage shell 10B would not be deprived of the intake air as the neighboring storage shells 10B could provide relief to the distressed shell 10B through an alternate pathway.

While one embodiment of a plumbing/layout for the piping network 50 is illustrated, the invention is not limited to any specific layout. Those skilled in the art will understand that an infinite number of design layouts can exist for the piping network 50. Furthermore, depending on the ventilation and air flow needs of any given manifold storage system, the piping network may or may not comprise headers and/or expansion joints. The exact layout and component needs of any piping network will be determined on case-by-case design basis.

The internal surfaces of the piping network 50 and the shells 10A, 10B are preferably smooth so as to minimize pressure loss. Similarly, ensuring that all angled portions of the piping network are of a curved configuration will further minimize pressure loss. The size of the pipes/ducts used in the piping network 50 can be of any size. The exact size of the ducts will be determined on case-by-case basis considering such factors as the necessary rate of air flow needed to effectively cool the canisters. In one embodiment, a combination of steel pipes having a 24 inch and 36 inch outer diameter are used.

Figure 7:
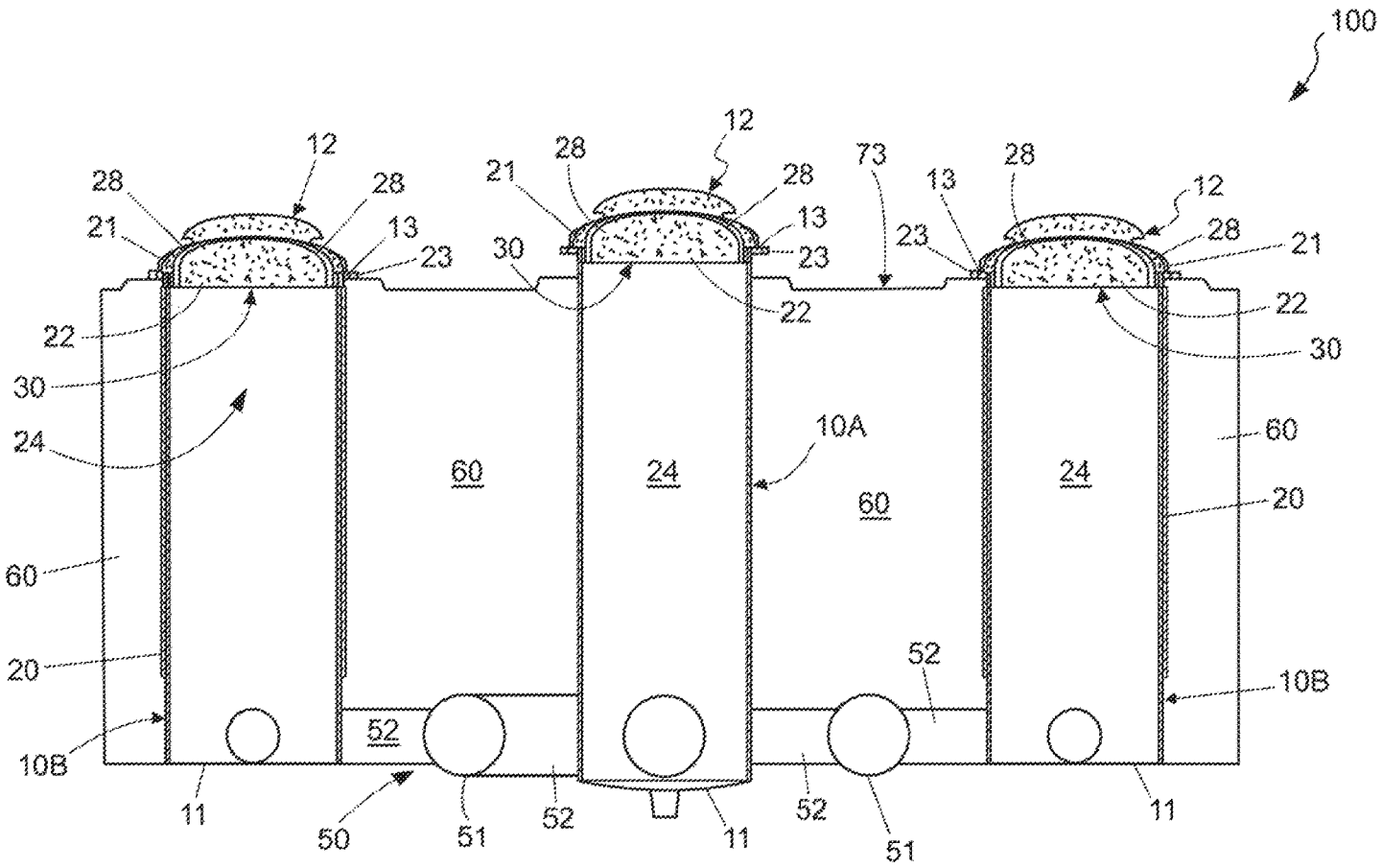
FIG. 7 is a cross-sectional view of the manifold storage system of FIG. 5 along perspective A-A wherein the manifold storage system has been positioned below grade and is free of canisters.

The components 51, 52, 53 of the piping network 50 are seal joined to one another at all connection points. Moreover, the piping network 50 is seal joined to all of the shells 10A, 10B to form an integral/unitary structure that is hermetically sealed to the ingress of water and other fluids. In the case of weldable metals, this seal joining may comprise welding or the use of gaskets. In the case of welding, the piping network 50 and the shells 10A, 10B will form a unitary structure. Moreover, as shown in FIG. 7, each of the shells 10A, 10B further comprise an integrally connected floor 11. Thus, the only way water or other fluids can enter any of the internal cavities of the shells 10A, 10B or the piping network 50 is through the top open end of the internal cavities.

An appropriate preservative, such as a coal tar epoxy or the like, is applied to the exposed surfaces of shells 10A, 10B and the piping network 50 to ensure sealing, to decrease decay of the materials, and to protect against fire. A suitable coal tar epoxy is produced by Carboline Company out of St. Louis, Mo. under the tradename Bitumastic 300M.

Figure 9:
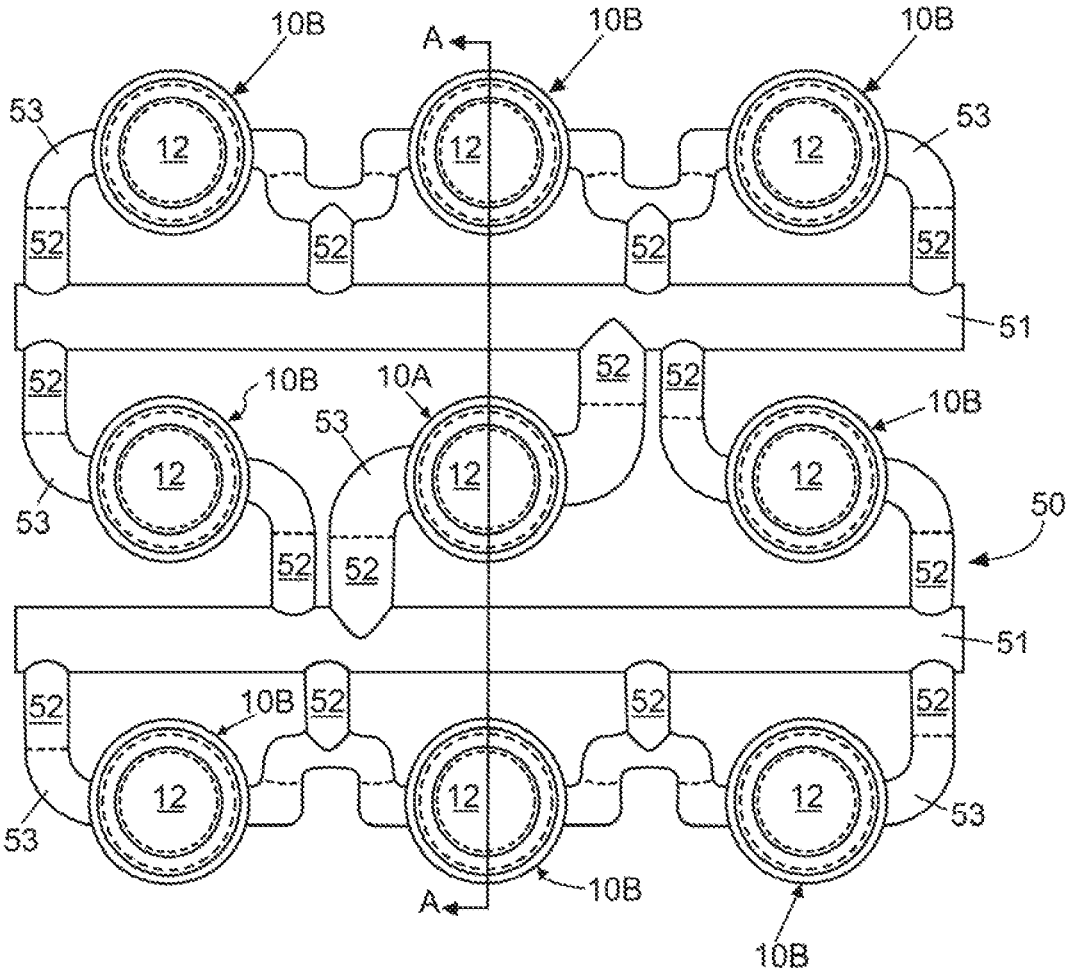
FIG. 9 is a top view of a manifold storage system according to an alternative embodiment of the present invention, wherein a line-of-sight does not exist between any two storage shells.

Referring to FIG. 9, the piping network. 50 can also be designed so that a direct line of sight does not exist between any two internal cavities of the storage shells 10B. This eliminates shine between canisters loaded in the cavities of the storage shells 10B, which is possible due to the fact that the network of pipes 50 connect to side walls of the storage shells 10B. Of course, the concept could be expanded to situations where the network of pipes 50 is connected to the floor of the storage shells 10B. Furthermore, the elimination of the line-of-sight between any two internal cavities of the storage shells 10B can be effectuated through a number of piping configurations, including the creation of a tortuous path, a segmented path, an angled path, or combinations thereof.

Figure 3:
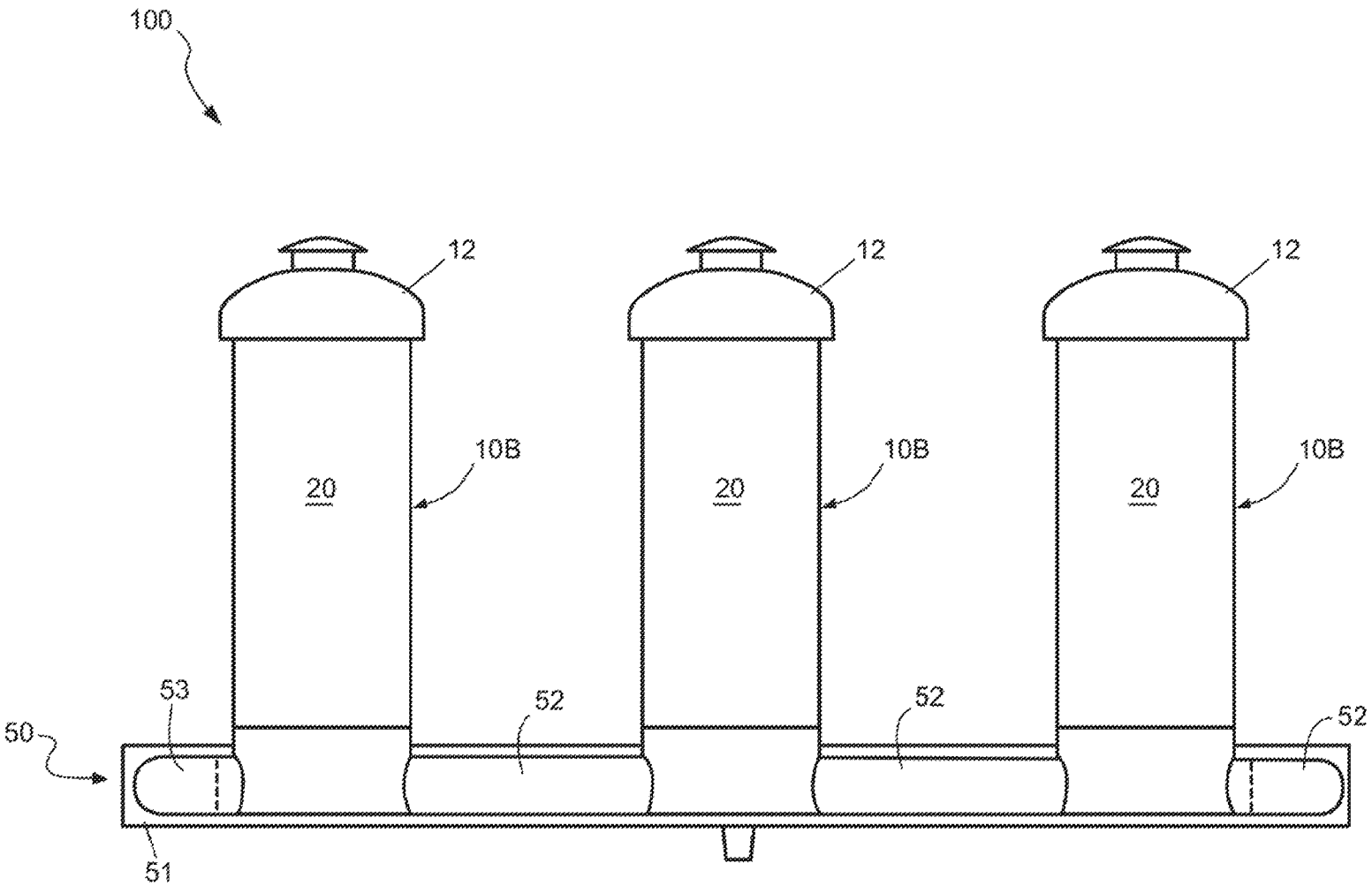
FIG. 3 is a front view of the manifold storage system of FIG. 2.

Referring now to FIGS. 2 and 3, it can be seen that a layer of insulating material 20 circumferentially surrounds each of the storage cavities 10B. Suitable forms of insulation include, without limitation, blankets of alumina-silica fire clay (Kaowool Blanket), oxides of alumina and silica (Kaowool S Blanket), alumina-silica-zirconia fiber (Cerablanket), and alumina-silica-chromia (Cerachrome Blanket). The insulation 20 prevents excessive transmission of heat from spent fuel canisters within the storage shells 10B to the surrounding structure material, such as the concrete monolith 60 (FIG. 7) the air-intake shell 10A and the piping network 50.

Insulating the storage shells 10B serves to minimize the heat-up of the incoming cooling air before it enters the cavities of the storage shells 10B. This facilitates in maintaining adequate ventilation/cooling of the spent fuel canisters stored therein. The insulating process can be achieved in a variety of ways, none of which are limiting of the present invention. For example, in addition to adding a layer of the insulating material 20 to the exterior of the storage shells 10B, insulating material can also be added to surround the components of the piping network 50 and/or the air-intake shell 10A. Furthermore, in addition to or instead of an insulating material, it may be possible to provide the necessary insulation of the incoming cool air by providing gaps in the concrete monolith 60 (FIG. 7) at the appropriate places. These gaps may be filled with an inert gas or air if desired.

Figure 4:
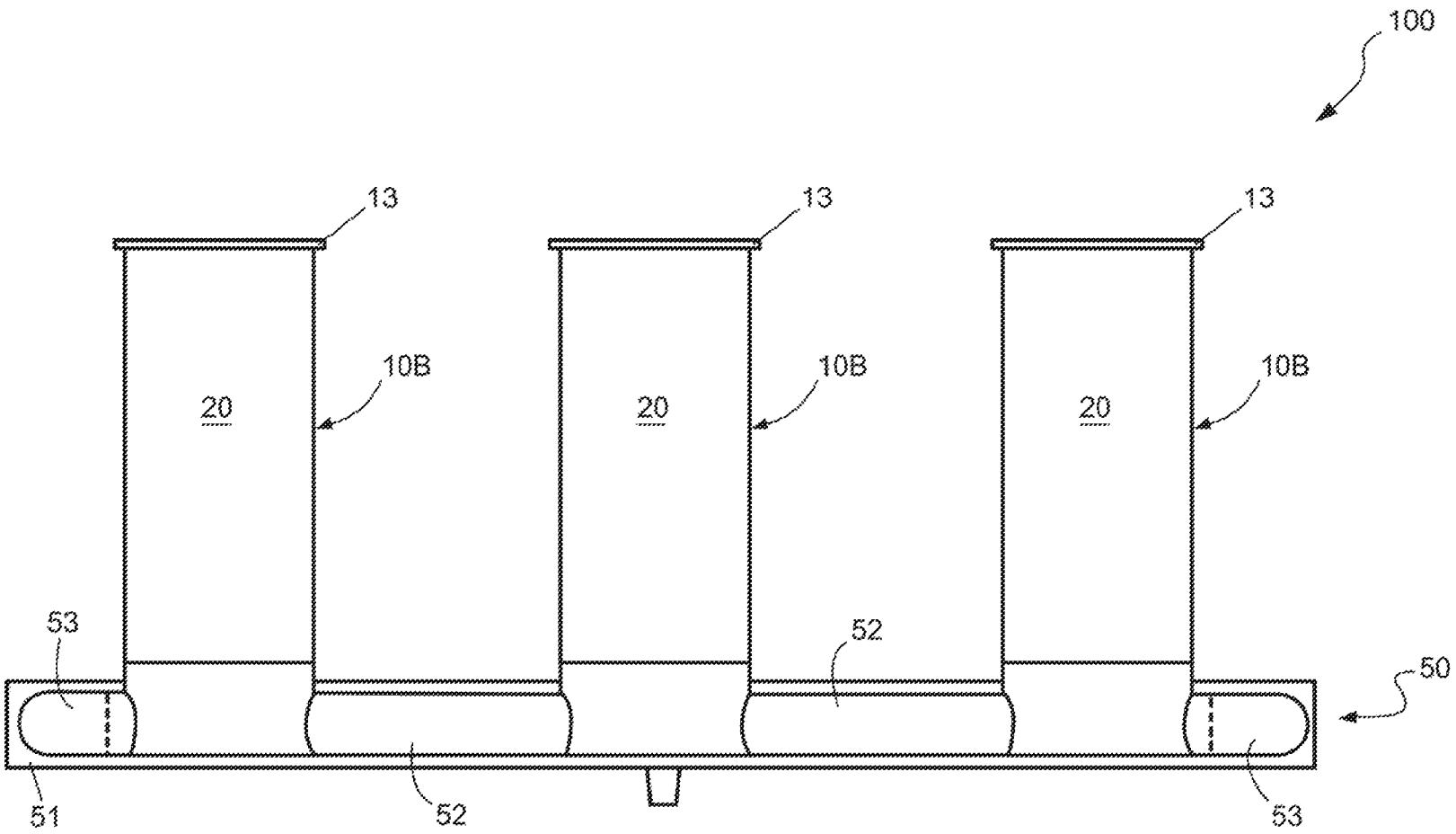
FIG. 4 is a front view of the manifold storage system of FIG. 2 wherein the lids have been removed from the storage and air-intake shells.
Figure 5:
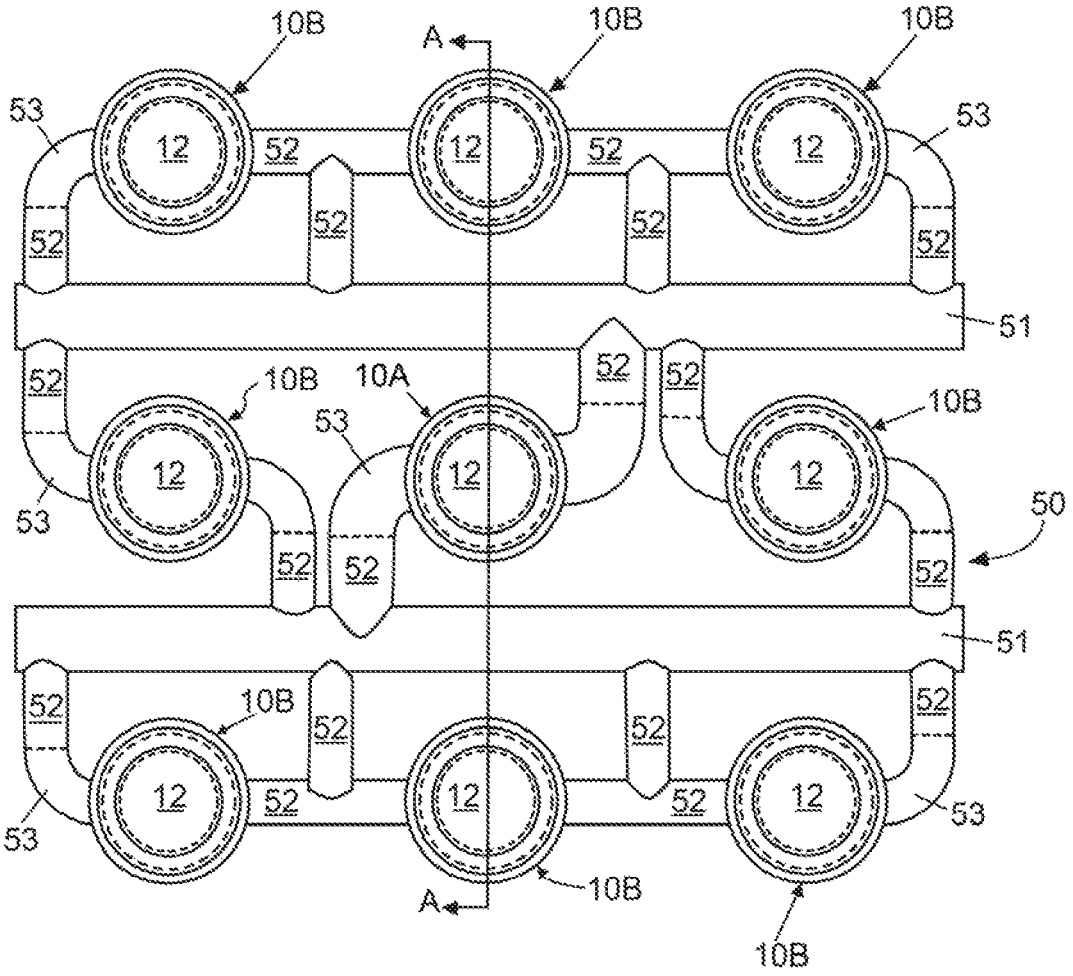
FIG. 5 is a top view of the manifold storage system of FIG. 2

Referring now to FIG. 4, the manifold storage system 100 is illustrated with the lids 12 removed from the shells 10A, 10B. As can be seen, each of the shells 10A, 10B comprise a container ring 13 at or near their top. The container rings 13 are thick steel ring-like structures. The container rings 13 circumferentially surround the periphery of the shells 10A, 10B and are secured thereto by welding or another connection technique. In addition to adding structural integrity to the shells 10A, 10B, the container rings 13 also interface with the shear rings 23 (FIGS. 6A, 6B) on the lids 12 to provide resistance to lateral forces.

With reference to FIGS. 3 and 4, it can be seen that the network of pipes 50 connects to side walls of the storage shells 10B and the air-intake shell 10A. Additionally, the storage shells 10B and the air-intake shell 10A are arranged in a side-by-side relation so that the bottoms surfaces of the shells 10A, 10B are located in the same plane. Preferably, the entirety of the network of pipes 50 is located in or above this plane (i.e., the network of pipes 50 does not extend below this plane).

Figure 6A:
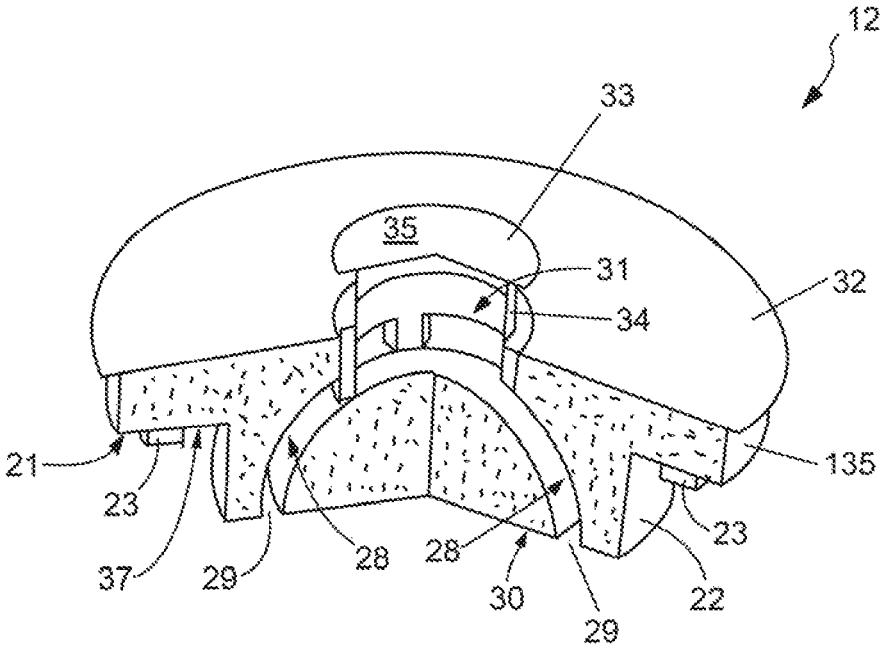
FIG. 6A is a top perspective view of an embodiment of a lid that can be used with the manifold storage system of FIG. 2 having a cut-out section.
Figure 6B:
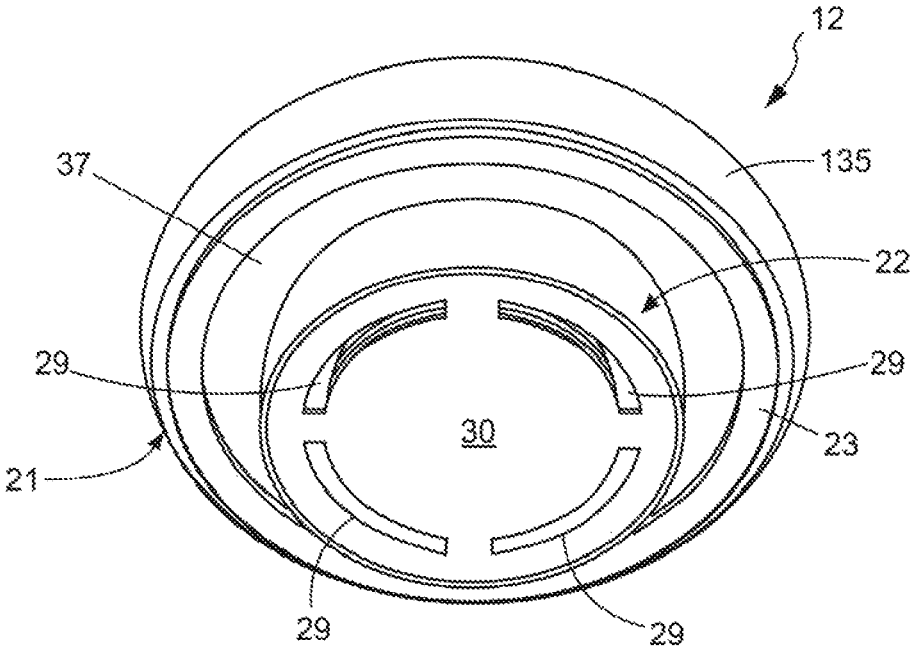
FIG. 6B is a bottom perspective view of the lid of FIG. 6A.

Referring to FIGS. 6A and 6B, the lid 12 is illustrated in detail according to an embodiment of the present invention. In order to provide the requisite radiation shielding for the spent fuel canisters stored in the storage shells 10B, the lid 12 is constructed of a combination of low carbon steel and concrete. More specifically, in constructing one embodiment of the lid 12, a steel lining is provided and filled with concrete (or another radiation absorbing material). In other embodiments, the lid 12 can be constructed of a wide variety of materials, including without limitation metals, stainless steel, aluminum, aluminum-alloys, plastics, and the like. In some embodiments, the lid may be constructed of a single piece of material, such as concrete or steel for example.

The lid 12 comprises a flange portion 21 and a plug portion 22. The plug portion 22 extends downward from the flange portion 21. The flange portion 21 surrounds the plug portion 22, extending therefrom in a radial direction. A plurality of outlet vents 28 are provided in the lid 12. Each outlet vent 28 forms a passageway from an opening 29 in the bottom surface 30 of the plug portion 22 to an opening 31 in the top surface 32 of the lid 12. A cap 33 is provided over opening 31 to prevent rain water or other debris from entering and/or blocking the outlet vents 28. The cap 33 is secured to the lid 12 via bolts or through any other suitable connection, including without limitation welding, clamping, a tight fit, screwing, etc.

The cap 33 is designed to prohibit rain water and other debris flom entering into the opening 31 while affording heated air that enters the vents 28 via the opening 29 to escape therefrom. In one embodiment, this can be achieved by providing a plurality of small holes (not illustrated) in the wall 34 of the cap 33 just below the overhang of the roof 35 of the cap. In other embodiments, this can be achieved by non-hermetically connecting the roof 35 of the cap 33 to the wall 34 and/or constructing the cap 33 (or portions thereof) out of material that is permeable only to gases. The opening 31 is located in the center of the lid 12.

In order to further protect against rain water or other debris entering opening 31, the top surface 32 of the lid 12 is sloped away from the opening 31 (i.e., downward and outward). The top surface 32 of the lid 12 (which acts as a roof) overhangs beyond the side wall 135 of the flange portion 21.

The outlet vents 28 are curved so that a line of sight does not exist therethrough. This prohibits a line of sight from existing from the ambient environment to a canister that is loaded in the storage shell 10B, thereby eliminating radiation shine into the environment. In other embodiments, the outlet vents may be angled or sufficiently tilted so that such a line of sight does not exist.

The lid 30 thriller comprises a shear ring 23 secured to the bottom surface 37 of the flange portion 31. The shear ring 23 may be welded, bolted, or otherwise secured to the bottom surface 37. The shear ring 23 is designed to extend downward from the bottom surface 37 and peripherally surround and engage the container ring 13 of the shells 10A, 10B, as shown in FIG. 7.

While not illustrated, it is preferable that duct photon attenuators be inserted into all of vents 28 of the lids 12 for both the storage shells 10B and the air-intake shell 10A, irrespective of shape and/or size. A suitable duct photon attenuator is described in U.S. Pat. No. 6,519,307, Bongrazio, the teachings of which are incorporated herein by reference in its entirety. It should be noted that in some embodiments, the air-intake shell 10A may not have a lid 12.

Referring now to FIG. 7, the cooperational relationship of the elements of the lid 12 and the elements of the shells 10A, 10B will now be described. In order to avoid redundancy, only the interaction of the lid 12 with a single storage shell 10B will be described in detail with the understanding that those skilled in the art will appreciate that the below discussion applies to all of the storage shells 10B and the air-intake shell 10A.

When the lid 12 is placed atop the storage shell 10B of the manifold storage system 100 (e.g., during the storage of a canister loaded with spent fuel), the plug portion 22 of the lid 12 is lowered into the cavity 24 formed by the storage shell 10B until the flange portion 21 of the lid 12 contacts and rests atop the storage shell 10B thereby forming a lid-to-shell interface. More specifically, the bottom surface 37 (FIG. 6B) of the flange portion 21 of the lid 12 contacts and rests atop the top surfaces of the storage shell 10B so as to form the lid-to-shell interface. The lid 12 and the storage shell 10B form a non-unitary structure.

At this point, the shear ring 23 of the lid 12 engages and peripherally surrounds the outside surface of the container ring 13. The interaction of the shear ring 23 and the container ring 13 provides enormous shear resistance against lateral forces from earthquakes, impactive missiles, or other projectiles. The lid 12 is secured in place via bolts (or other fastening means) that can either extend into holes in the concrete monolith 60 or into the storage shell 10B itself. While the lid 12 is secured the storage shell 10B and/or the concrete monolith 60, the lid 12 remains non-unitary and removable. While not illustrated, one or more gaskets can be provided at some position at the lid-to-shell interface so as to form a hermetically sealed interface, When the lid 12 is properly positioned atop the storage shell 10B as illustrated in FIG. 7, the vents 28 are in spatial cooperation with the cavity 24 formed by the storage shell 10B. In other words, each of the vents 28 form a passageway from the ambient atmosphere to the cavity 24 itself. The vents in the lid positioned atop the air-intake shell 10A provide a similar passageway. With respect to the air-intake shell 10A, the vents 28 act as a passageway that allows cool ambient air to siphoned into the cavity 24 of the air-intake shell 10A, through the piping network 50, and into the bottom portion of the cavities 24 of the storage shells 10B. When a canister containing spent fuel (or other HLW) having a heat load is positioned within the cavities 24 of one or more of the storage shells 10B, this incoming cool air is warmed by the canister, rises within the cavity 24, and exits the cavity 24 via the vents 28, in the lids 12 atop the storage shells 10B. It is this chimney effect that creates the siphoning effect in the air-intake shell 10A.

Figure 8:
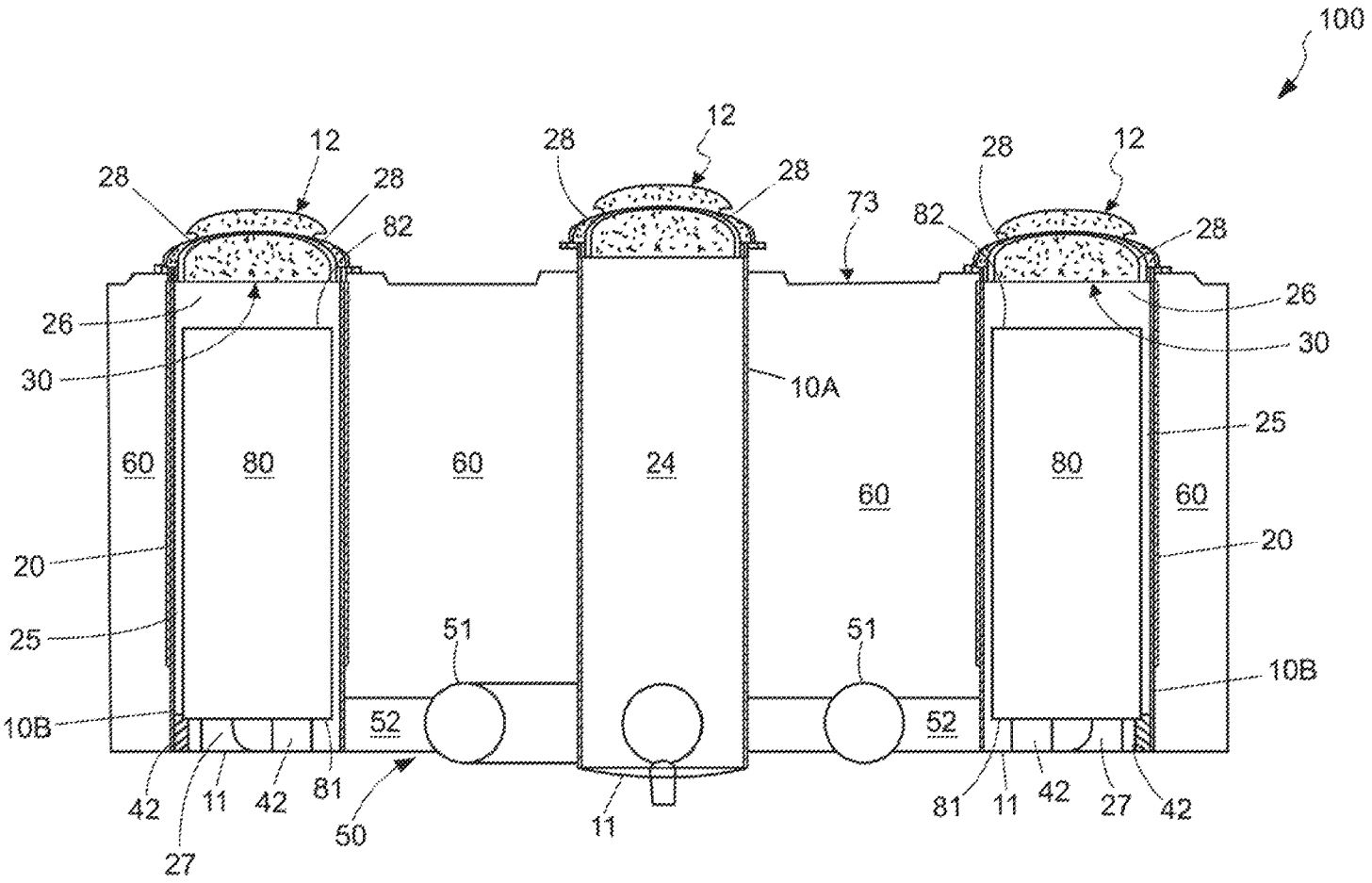
FIG. 8 is side cross sectional view of the manifold storage system of FIG. 7 wherein canisters containing high level waste have been positioned in the storage cavities according to an embodiment of the present invention.

Referring now to FIGS. 7 and 8, the shells 10A, 10B form vertically oriented cylindrical cavities 24 therein. While the cavities 24 are cylindrical in shape, the cavities 24 are not limited to any specific shape, but can be designed to receive and store almost any shape of canister without departing, from the spirit of the invention. The horizontal cross-sectional size and shape of the cavities 24 of the storage shells 10B are designed to generally correspond to the horizontal cross-sectional size and shape of the spent fuel canisters 80 (FIG. 8) that are to be stored therein. The horizontal cross-section of the cavities 24 of the storage shells 10B accommodate no more than one canister 80 of spent fuel.

The horizontal cross-sections of the cavities 24 of the storage shells 10B are sized and shaped so that when spent fuel canisters 80 are positioned therein for storage, a small gap/clearance 25 exists between the outer side walls of the canisters 80 and the side walls of cavities 24. When the shells 10B and the canisters 80 are cylindrical in shape, the gaps 25 are annular gaps. In one embodiment, the diameter of the cavities 24 of the storage shells 10B is in the range of 5 to 7 feet, and more preferably approximately 6 feet.

Designing the cavities 24 of the storage shells 10B so that a small gap 25 is formed between the side walls of the stored canisters 80 and the side walls of cavities 24 limit the degree the canisters 80 can move within the cavities 24 during a catastrophic event, thereby minimizing damage to the canisters 80 and the cavity walls and prohibiting the canisters 80 from tipping over within the cavities 24. These small gap 25 also facilitates flow of the heated air during spent nuclear fuel cooling. The exact size of the gap 25 can be controlled/designed to achieve the desired fluid flow dynamics and heat transfer capabilities for any given situation. In one embodiments, the gap 25 has a width of about 1 to 3 inches. Making the width of the gap 25 small also reduces radiation streaming.

Support blocks 42 are provided on the floors 11 of the cavities 24 of the storage shells 10B so that the canisters 80 can be placed thereon. The support blocks 42 are circumferentially spaced from one another around the floor 11. When the canisters 80 are loaded into the cavities 24 of the storage shells 10B, the bottom surfaces 81 of canisters 80 rest on the support hocks 42, forming an inlet air plenum 27 between the bottom surfaces 81 of the canisters 80 and the floors 11 of the cavities 24. The support blocks 42 are made of low carbon steel and are preferably welded to the floors 11 of the cavities 26 of the storage shells 10B. Other suitable materials of construction include, without limitation, reinforced-concrete, stainless steel, and other metal alloys.

The support blocks 42 also serve an energy/impact absorbing function. The support blocks 32 are preferably of a honeycomb grid style, such as those manufactured by Hexcel Corp., out of California, U.S.

When the canisters 80 are positioned atop the support blocks 32 within the storage shells 10B, outlet air plenums 26 are formed between the top surfaces 82 of the canisters 80 and the bottom surfaces 30 of the lids 12. The outlet air plenums 36 are preferably a minimum of 3 inches in height, but can be any desired height. The exact height will be dictated by design considerations such as desired fluid flow dynamics, canister height, shell height, the depth of the cavities, the canister's heat load, etc.

The cavity 24 of the air-intake shell 10A is deeper than the cavities 24 of the storage shells 10B and serves as a sump for ground water or rain water (if there is a leak and/or debris). The cavity 24 of the air-intake shell 24 is typically empty and, therefore, can be readily cleared of debris. Additionally, the piping network 50 is preferably sloped toward the air-intake shell 10A and away from the storage shells 10B so that any water seepage collects in the bottom of the cavity 24 of the air-intake shell 10A. If desired, a drain can be included at the bottom on the cavity 24 of air-intake shell 10B.

In FIGS. 7 and 8, the illustrated embodiment of the manifold storage system 100 further comprises a concrete monolith 60 surrounding the shells 10A, 10B and piping network 50. The concrete monolith 60 provides the necessary radiation shielding for the spent fuel canisters 80 stored in the storage shells 10B. The concrete monolith 60 provides non-structural protection for shells 10A, 10B and the piping network 50. The entire height of the shells 10A, 10B are surrounded by the concrete monolith 60 with only the lids 12 protruding therefrom and resting atop its top surface.

While the vents 28 that allow the warmed air to escape the storage shells 10B are illustrated as being located within the lids 12, the present invention is not so limited. For example, the vents 28 can be located in the concrete monolith 60 itself. In such an embodiment, the openings of the vents to the ambient air can be located in the top surface of the monolith 60 and a line of sight should not exist to the ambient. Similar to when the outlet vents are located in the lid, the outlet vents can take on a variety of shapes and/or configurations, such as S-shaped or L-shaped. In all embodiments of the present invention, it is preferred that the outlet openings of the vents 28 from the storage shells 10B be azimuthally and circumferentially separated from the intake openings of the vents 28 into the air-intake shell 10A to minimize interaction between inlet and outlet air streams.

As discussed above, a layer of insulating material 20 is provided at the interface between storage shells 10B and the concrete monolith 60 (and optionally at the interface between the concrete monolith 60 and the piping network 50 and the air-intake shell 10A. The insulation 20 is provided to prevent excessive transmission of heat decay from the spent fuel canisters 80 to the concrete monolith 60, thus maintaining the bulk temperature of the concrete within FSAR limits. The insulation 20 also serves to minimize the heat-up of the incoming cooling air before it enters the cavities 24 of the storage shells 10B.

As mentioned above, the manifold storage system 100 is particularly suited to effectuate the storage of spent nuclear fuel and other high level waste in a below grade environment. Referring to FIG. 8, the manifold storage system 100 is positioned so that the entire concrete monolith 60 (including the entire height of the storage shells 10B) is entirely below the grade level 73 at an ISFSI. The entire piping network 50 is also located deep underground.

By positioning the manifold storage system 100 below grade level 73, the system 100 is unobtrusive in appearance and there is no danger of tipping over. The low profile of the underground manifold storage system 100 does not present a target for missile or other attacks. Additionally, the underground manifold storage system 100 does not have to contend with soil-structure interaction effects that magnify the free-field acceleration and potentially challenge the stability of an above ground free-standing overpack.

While the entire height of the storage shells 10B is illustrated as being below grade level 73, in alternative embodiments a portion of the storage shells 10B can be allowed to protrude above the grade level 73. In such embodiments, at least a major portion of the height of the storage shells 10B are positioned below grade level 73. Any portion of the storage shells 10B that protrude above the grade level 73 must be surrounded by the necessary radiation shielding structure. In all embodiments, the Storage shells 10B are sufficiently below grade level so that when canisters 80 of spent fuel are positioned in the cavities 24 for storage, the entire height of the canisters are below the grade level 73. This takes full advantage of the shielding effect of the surrounding soil at the ISFSI. Thus, the soil provides a degree of radiation shielding for spent fuel stored that can not be achieved in aboveground overpacks.

With reference to the manifold storage system 100, a method of constructing the underground manifold storage system of FIG. 7 at an ISFSI or other location, will be discussed. First, a hole is dug into the ground at a desired position at the ISFSI having a desired depth. Once the hole is dug and its bottom properly leveled, a base foundation is placed at the bottom of the hole. The base can be a reinforced concrete slab designed to satisfy the load combinations of recognized industry standards, such as ACI-349. However, in some instances, depending on the load to be supported and/or the ground characteristics, the use of a base may be unnecessary.

Once the foundation/base is properly positioned in the hole, the integral structure of FIG. 2 (which consists of the storage shells 10B, the air-intake shell 10A, and the piping network 50) is lowered into the hole in a vertical orientation until it rests atop the base. The integral structure then contacts and rests atop the top surface of the base. If desired, the integral structure can be bolted or otherwise secured to the base at this point to prohibit future movement of the integral structure with respect to the base.

Once the integral structure is resting atop the base in the vertical orientation, the hole is filled with concrete to form the concrete monolith 60 around the integral structure. The concrete monolith 60 also acts a moisture barrier to the below grade components. Alternatively, soil or an engineered fill can be used instead of concrete to fill the hole. Suitable engineered fills include, without limitation, gravel, crushed rock, concrete, sand, and the like. The desired engineered fill can be supplied to the hole by any means feasible, including manually, dumping, and the like.

The concrete is supplied to the hole until it surrounds the integral structure and fills hole to a level where the concrete reaches a level that is approximately equal to the ground level 73. When the hole is filled, the concrete monolith 60 is formed. The shells 10A, 10B protrude slightly from the top surface of the concrete monolith 60 so that the cavities 24 of the shells 10A, 10B are accessible from above grade. Additionally, the lids 12 can be positioned atop the shells 10A, 10B as described above. Because the integral structure is hermetically sealed at all below grade junctures, below grade liquids can not enter into the cavities 24 of the shells 10A, 10B or the piping network 50.

An embodiment of a method of using the underground manifold system 100 of FIGS. 7 and 8 to store a spent nuclear fuel canister 80 will now be discussed. Upon being removed from a spent fuel pool and treated for dry storage, the spent filet canisters 80 is hermetically sealed and positioned in a transfer cask. The transfer cask is then carried by a cask crawler to an empty storage shell 10B for storage. Any suitable means of transporting the transfer cask to a position above the storage shell 10B can be used. For example, any suitable type of load-handling device, such as without limitation, a gantry crane, overhead crane, or other crane device can be used.

In preparing the desired shell 10B to receive the canister 80, the lid 12 is removed so that the cavity 24 of the storage shell 10B is open and accessible from above. The cask crawler positions the transfer cask atop the storage shell 10B. After the transfer cask is properly secured to the top of the storage shell 10B, a bottom plate of the transfer cask is removed. If necessary, a suitable mating device can be used to secure the connection of the transfer cask to storage shell 10B and to remove the bottom plate of the transfer cask to an unobtrusive position. Such mating devices are well known in the art and are often used in canister transfer procedures. The canister 80 is then lowered by the cask crawler from the transfer cask into the cavity 24 of the storage shell 10B until the bottom surface 81 of the canister 80 contacts and rests atop the support blocks 42 on the floor 11 of the cavity 24. The canister 80 is free-standing in the cavity 24, free of anchors or other securing means.

When resting on the support blocks 42 within the cavity 24 of the storage shell 10B, the entire height of the canister 80 is below the grade level 73. Once the canister 80 is positioned and resting in the cavity 24, the lid 12 is positioned atop the storage shell 10B, substantially enclosing the cavity 24. The lid 12 is then secured to the concrete monolith 60 via bolts or other means. When the canister 80 is so positioned within the cavity 24 of the storage shell 10B, an inlet air plenum 27 exists between the floor 11 and the bottom surface 81 of the canister 80. An outlet air plenum 27 exists between the bottom surface 30 of the lid 12 and the top surface 82 of the canister 80. A small annular gap 25 also exists between the side walls of the canister 80 and the wall of the storage shell 10B.

As a result of the chimney effect caused by the heat emanating from the canister 80, coot air from the ambient is siphoned into the cavity 24 of the air-intake shell 10A via the vents 28 in its lid 12. This cool air is then siphoned through the piping network 50 and into the inlet air plenum 27 at the bottom of the cavity 24 of the storage shells 10B. This cool air is then warmed by the heat emanating from the spent fuel canister 80, rises in the cavity 24 via the annular gap 25 around the canister 80, and into the outlet air plenum 26 above the canister 80. This warmed air continues to rise until it exits the cavity 24 as heated air via the vents 28 in the lid 12 positioned atop the storage shell 10B.

While the invention has been described and illustrated in sufficient detail that those skilled in this art can readily make and use it, various alternatives, modifications, and improvements should become readily apparent without departing from the spirit and scope of the invention Specifically, in one embodiment, the shells 10A, 10B and/or the piping network 50 can be omitted. In this embodiment, the cavities of the shells and the passageways of the piping network can be formed directly into the concrete monolith if desired.

What is claimed is:

1. A method for storing and cooling nuclear waste canisters comprising:

providing a manifold storage system comprising a vertical air inlet downcomer, a piping network fluidly coupled to the downcomer, and a plurality of vertically oriented storage shells each fluidly coupled to the piping network, each storage shell forming a cavity configured for holding a nuclear waste canister;

positioning a hermetically sealed nuclear waste canister containing high level nuclear waste into each cavity of the storage shells to form an annular gap between each canister and their respective shells, the nuclear waste generating heat;

drawing cooling air from the ambient atmosphere into the downcomer;

distributing the cooling air from the downcomer through the piping network to the storage shells;

introducing the cooling air into the annular gaps of each storage shell;

heating the cooling air via the nuclear waste in each storage shell thereby producing heated air; and venting the heated air from the storage shells back to the ambient atmosphere.

* * * * *